US006910314B2

(12) United States Patent
Le

(10) Patent No.: US 6,910,314 B2
(45) Date of Patent: Jun. 28, 2005

(54) RANDOM AUTOMATIC CASE SEALER

(76) Inventor: Tuan Vinh Le, 3695 Kaneff Crescent, Suite 2006, Ontario (CA), L5A 4B6

( * ) Notice: Subject to any disclaimer, the term of this patent is extended or adjusted under 35 U.S.C. 154(b) by 0 days.

(21) Appl. No.: 10/330,268

(22) Filed: Dec. 30, 2002

(65) Prior Publication Data

US 2004/0123559 A1 Jul. 1, 2004

(51) Int. Cl.[7] ..... B65B 61/00

(52) U.S. Cl. ..... 53/136.4; 53/136.3; 53/377.2; 53/378.3; 53/75; 493/117; 493/147

(58) Field of Search ..... 53/136.4, 136.3, 53/136.1, 377.2, 378.3, 491, 415, 282, 387.2, 75; 493/78, 116, 117, 147, 183, 156, 157, 478; B65B 59/02

(56) References Cited

U.S. PATENT DOCUMENTS

| | | | | | |
|---|---|---|---|---|---|
| 1,887,699 | A | | 11/1932 | Reid | |
| 3,282,018 | A | | 11/1966 | Bixley | |
| 3,466,843 | A | | 9/1969 | Mumper | |
| 3,775,937 | A | | 12/1973 | Devan et al. | |
| 3,894,380 | A | * | 7/1975 | Poulsen | 53/75 |
| 4,161,138 | A | | 7/1979 | Marchetti | |
| 4,218,862 | A | * | 8/1980 | Marchetti | 53/377.2 |
| 4,262,468 | A | * | 4/1981 | Marchetti | 53/67 |
| 4,293,086 | A | * | 10/1981 | Fincher et al. | 225/1 |
| 4,554,042 | A | | 11/1985 | Marchetti | |
| 4,585,504 | A | | 4/1986 | Marchetti | |
| 5,099,979 | A | | 3/1992 | Kehrel | |
| 5,323,586 | A | * | 6/1994 | Lissoni et al. | 53/136.4 |
| 5,685,814 | A | | 11/1997 | Le | |
| 5,916,106 | A | * | 6/1999 | Chen | 53/136.4 |
| 6,067,773 | A | | 5/2000 | Le | |
| 2004/0093829 | A1 | * | 5/2004 | Marchetti | |

FOREIGN PATENT DOCUMENTS

| | | |
|---|---|---|
| EP | 0 667 287 | 8/1995 |
| FR | 1438303 | 4/1966 |
| GB | 1048674 | 11/1966 |

* cited by examiner

*Primary Examiner*—Louis K. Huynh
*Assistant Examiner*—Thanh Troung
(74) *Attorney, Agent, or Firm*—Ridout & Maybee LLP

(57) ABSTRACT

A case sealer has a frame with a conveyor for moving boxes into a pair of spaced-apart lateral conveyors. The lateral conveyors have converging centering conveyor belts that center the boxes and first advancing conveyor belts that open to the width of the box to be sealed. A floating head located over the lateral conveyors folds the box end and side flaps into a closed position. The box is then picked up by a pair of second advancing conveyors that adjust to the width of the box. The second advancing conveyors are mounted on a seal dispensing platform carrying a tape dispenser for sealing the box flaps shut.

19 Claims, 8 Drawing Sheets

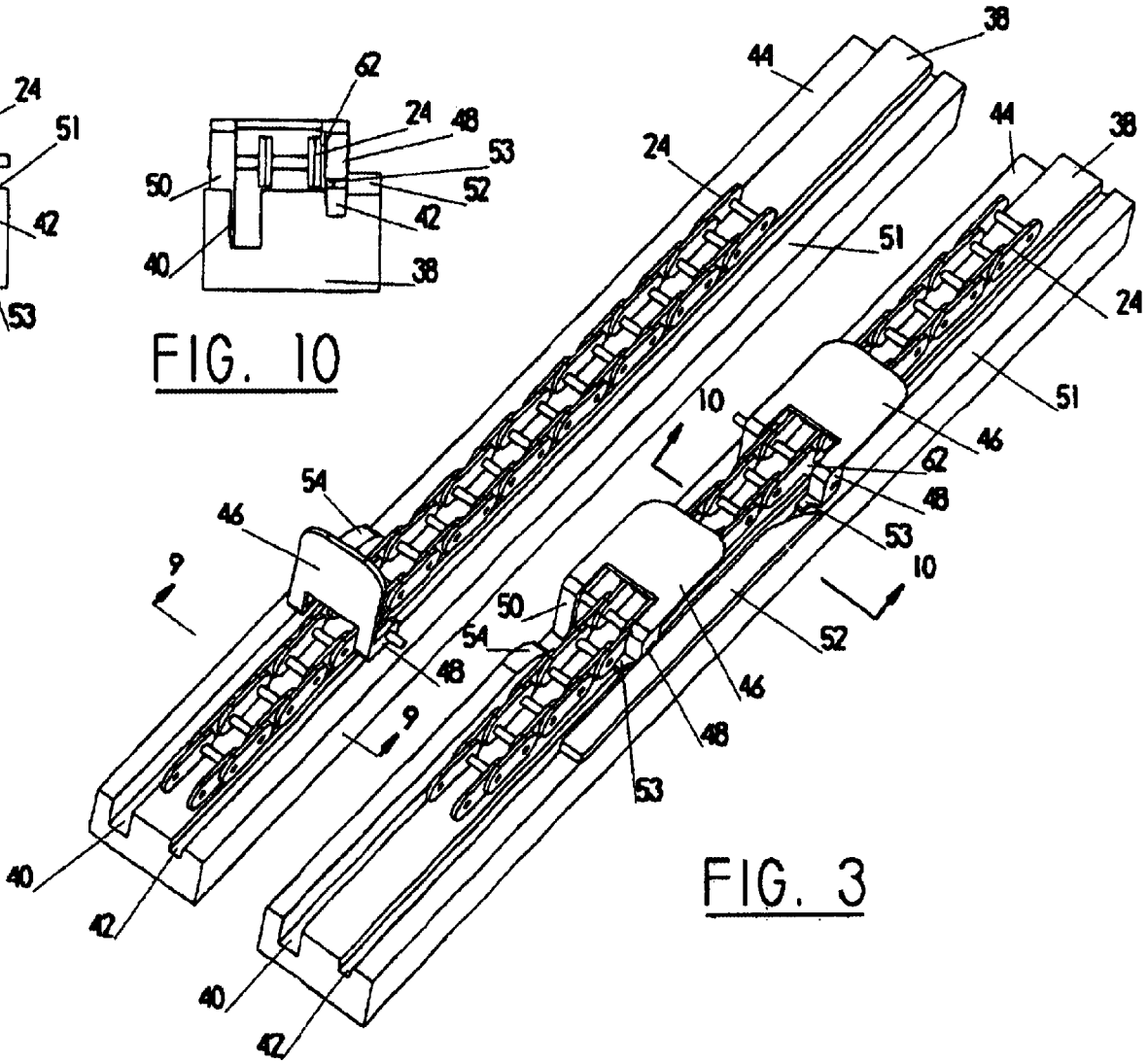
FIG. 3
FIG. 10
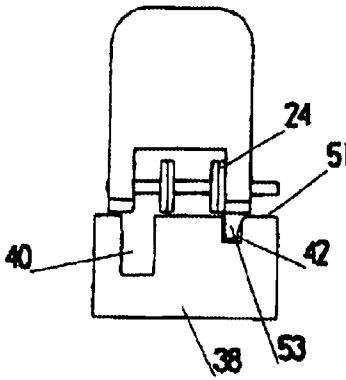
FIG. 9

RANDOM AUTOMATIC CASE SEALER

This invention relates to box or case sealers for closing the open ends of cardboard boxes or cartons.

BACKGROUND OF THE INVENTION

In the packaging industry, many products are packed in cardboard boxes or cartons for shipping. Often, one end of the box, namely the bottom, is sealed shut before the box is filled, and after the box is filled, the open top end of the box usually has end and side flaps that are folded inwardly and downwardly. The box can be sealed by applying glue to the inside of the mating surfaces of the folded flaps prior to them being folded shut, or by applying tape to the outside of the flaps after they have been folded shut.

In many cases, the boxes are uniform in size, so providing apparatus that will fold the flaps and apply adhesive or tape thereto is not particularly difficult to do. The apparatus can be adjusted to suit the known width and the height of the boxes and there is usually no problem running the boxes through the case sealer once it has been adjusted properly.

However, sometimes the boxes are of different sizes coming down the same conveyor line. In these instances, a random case sealer is required, wherein the apparatus for folding the box flaps and applying adhesive or tape thereto adjusts automatically to suit the size of the box.

In prior art random case sealers, various sensors have been used to try to determine the exact size or position of the boxes entering the case sealer, and numerous actuators or other adjust mechanisms together with suitable control devices, have been used to adjust the position of the various folding and sealing components to suit the position and size of the box being sealed. A difficulty with this type of apparatus however, is that the boxes are often misshaped or underfilled or overfilled, so that they are not uniform in shape so the sensors often cannot determine the optimum position adjustments. The result is that the boxes get jammed in the apparatus shutting down the packaging line.

The jamming problem was largely overcome by the box sealer apparatus described in U.S. Pat. No. 5,685,814 issued to Tuan Vinh Le. In this patent, the folding and sealing components of the apparatus are gravitationally biased and positioned by contact with the actual box being sealed, so any variations in the shape of the box are automatically accommodated. Sometimes, however, the cardboard or box board used to make the cartons is not as thick or strong as it should be, or the boxes are underfilled, in which case the boxes can still be deformed during the sealing operation with undesirable results.

SUMMARY OF THE INVENTION

In the present invention, the folding and sealing components of the apparatus are positioned by contact with the actual box being sealed, thus accommodating non-uniformity of the boxes, yet the forces on the box components are controlled, so as to avoid the application of excessive force to the boxes.

According to the invention, there is provided a case sealer comprising a frame having a longitudinal axis and including an entrance conveyor for moving boxes entering the case sealer along the axis. A pair of longitudinal, spaced-apart, lateral conveyors is located to receive boxes from the entrance conveyor. Linking means are provided for linking the lateral conveyors together for equal movement inwardly and outwardly to match the width of a box passing therethrough. The lateral conveyors include converging centering conveyor belts forming a throat to center a box therebetween, and means actuatable upon a box contacting both centering conveyor belts for moving the lateral conveyors outwardly while maintaining the box in contact with both centering conveyor belts. The lateral conveyors also include parallel first advancing conveyor belts for receiving a box from the centering conveyor belts, and means for urging the lateral conveyors inwardly for engagement of the first advancing conveyor belts with the box. A floating head is spaced above the lateral conveyors, the floating head including an upwardly inclined entry ramp adapted to engage and fold inwardly a forward end flap on a box. Means are provided for lifting the floating head upwardly. The entry ramp includes a sensor switch operatively connected to the means for lifting the floating head upwardly, the switch being activated to raise the floating head upon a top horizontal edge of the box engaging the inclined entry ramp, and deactivated when the floating head is clear of the top of the box. The floating head includes a pivoting arm assembly including a pivot arm pivotable downwardly after the box passes thereunder to fold inwardly a rearward end flap on the box. The floating head further includes diverging side bars for engaging and folding inwardly side flaps on the box after the rearward end flap has been folded inwardly. A seal dispensing platform is located downstream of the first advancing conveyor belts. The seal dispensing platform includes means for holding box flaps shut and means for locating the holding means adjacent to the box flaps. The seal dispensing platform is adapted to mount a seal dispenser centrally thereon for sealing the box flaps shut. The seal dispensing platform includes spaced-apart, parallel second advancing conveyors located to receive boxes from the first advancing conveyor belts, and means for urging the second advancing conveyors into engagement with a box for passing the box under the seal dispenser platform and out of the case sealer.

BRIEF DESCRIPTION OF THE FIGURES

Preferred embodiments of the invention will now be described, by way of example, with reference to the accompanying drawings, in which:

FIG. 3 is an enlarged perspective view of a portion of the entrance conveyor of the case sealer of FIGS. 1 and 2;

FIG. 9 is a sectional view taken along lines 9—9 of FIG. 3; and

FIG. 10 is a sectional view taken along lines 10—10 of FIG. 3.

DETAILED DESCRIPTION OF THE PREFERRED EMBODIMENTS

Figure 1:
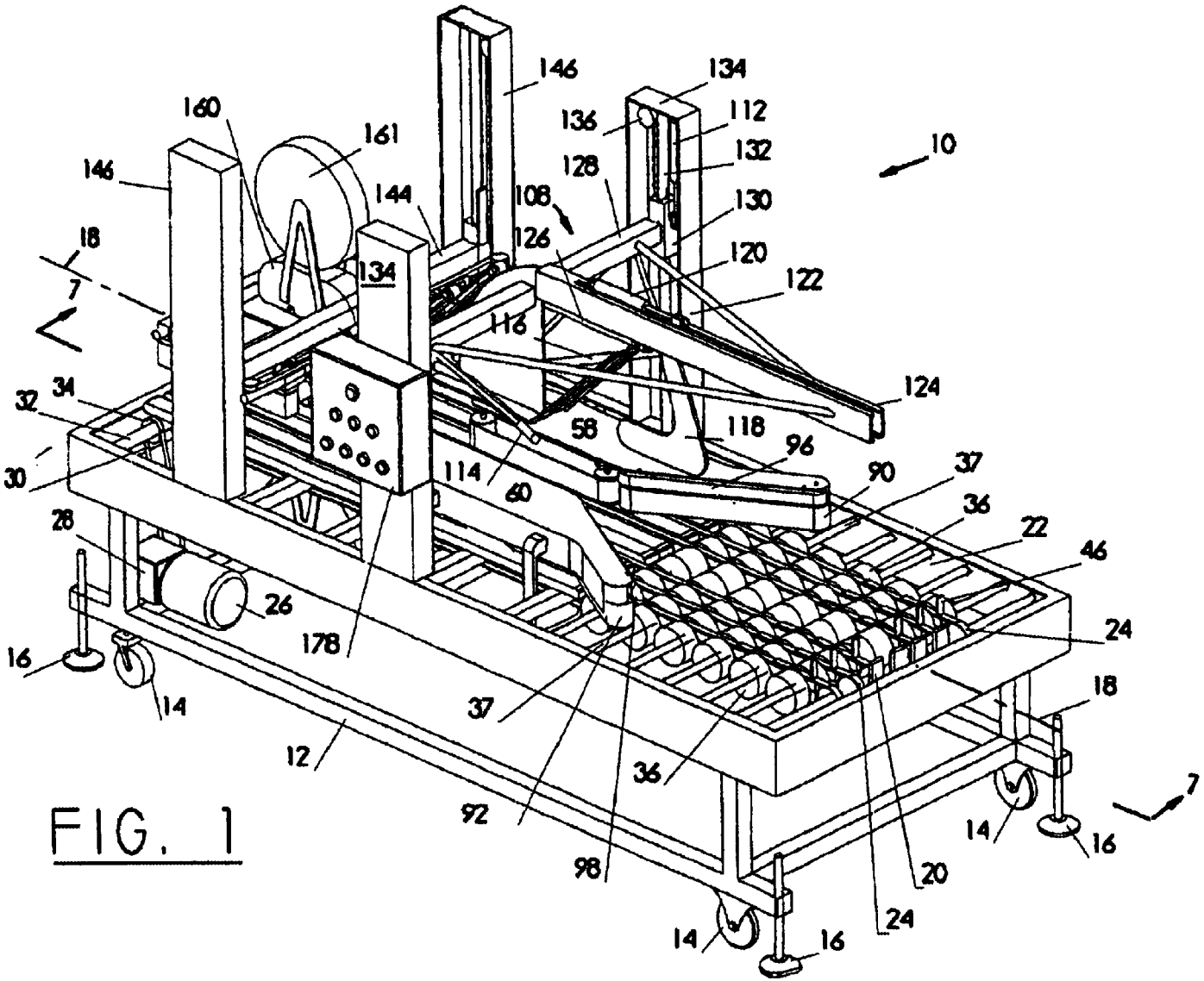
FIG. 1 is a perspective view taken from above and from the entrance end of a preferred embodiment of a case sealer according to the present invention.
Figure 2:
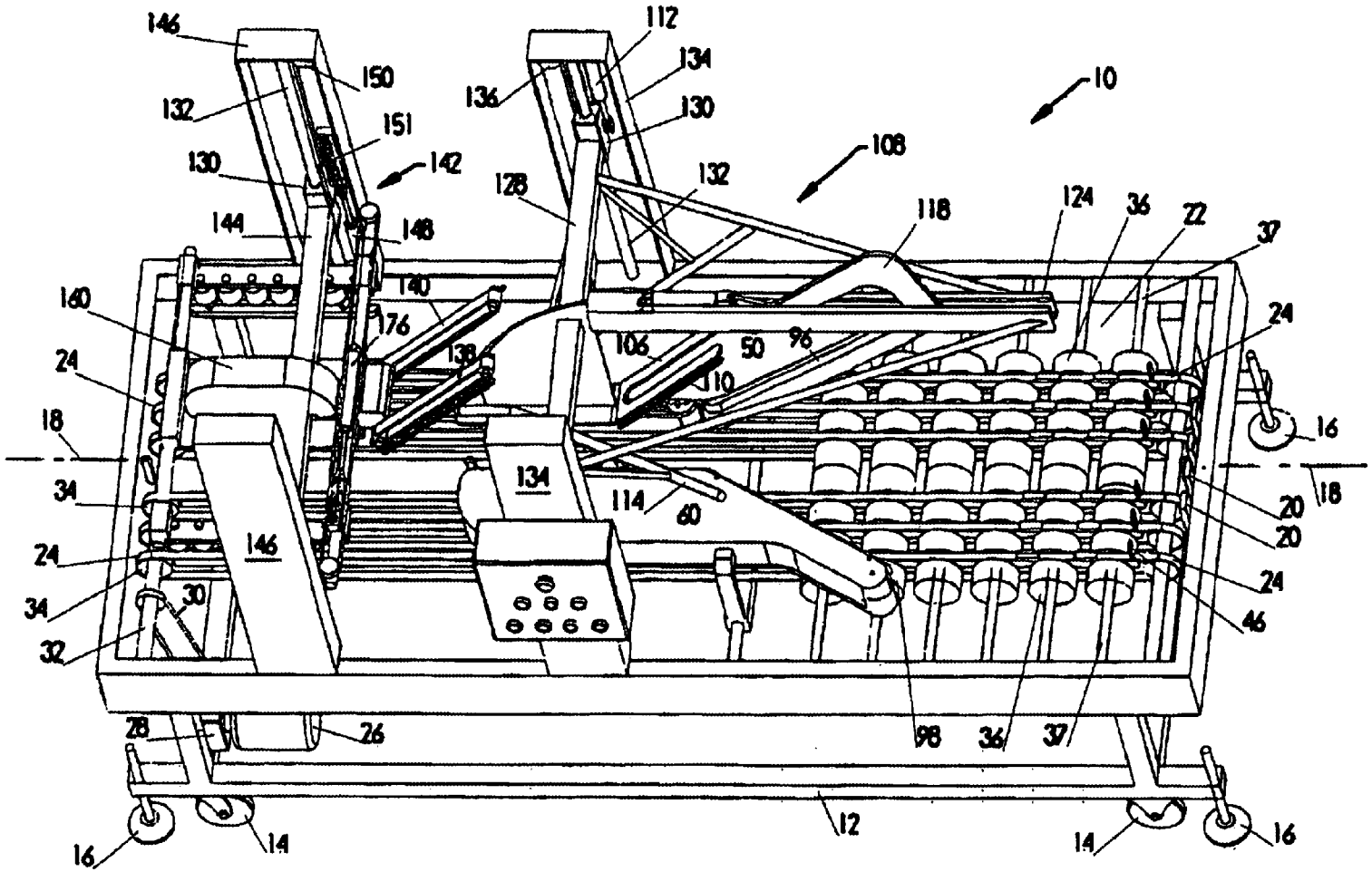
FIG. 2 is a perspective view similar to FIG. 1 but taken from a higher and more rearward angle and with some parts omitted for the purposes of clarity.

Referring to the drawings, a preferred embodiment of a case sealer according to the present invention is generally indicated in the drawings by reference numeral 10. Case sealer 10 includes a frame 12 mounted on castors 14, so that the case sealer is easily transportable or movable from one packaging line to another. Retractable feet 16 are threadably mounted in frame 12 to engage the floor and make case sealer stationary, if desired. Frame 12 has a longitudinal axis 18 which indicates the direction in which boxes or cartons or cases travel to be closed and sealed shut in case sealer 10.

Case sealer 10 is normally located adjacent to a packaging line (not shown) to close and seal, one at a time, filled boxes received from such a packaging line. However, boxes or cartons could be manually placed on case sealer 10 if desired. Where the cases are received from a packaging line, a gate mechanism 20 can be provided to space the cases apart prior to being closed and sealed, as will be described further below. However, the gate mechanism could be provided on the end of the packaging line rather than on case sealer 10, if desired.

Case sealer 10 includes an entrance conveyor 22 which has a plurality of spaced-apart, longitudinal endless conveyor chains or belts 24. Conveyor chains 24 extend the full length of case sealer 10. Chains 24 are driven by a motor 26 and gear box 28 driving another drive chain 30, which in turn rotates a shaft 32 having a sprocket 34 mounted thereon. Shaft 32 has additional sprockets 34 to drive each of the continuous chains 24. Chains 24 operate at speeds typically between about 15 to 25 meters per minute.

Entrance conveyor 22 also includes a plurality of rollers 36 located between conveyor chains 24 to support the boxes thereon. Rollers 36 are driven by chains 24 using suitable sprockets attached thereto or to the shafts 37 on which the rollers are mounted.

Pushers 46 can either be biased by gravity to lie down or springs (not shown) could be used for this purpose. The pushers that were upright also move laterally under the force of springs 62, so that they will not pop upright unless they are forced to do so at the appropriate time by cam 52. When pushers 46 reach the ends of tracks 38, tabs 53 come out of grooves 42 and the pushers then lie down again until they come around by the return of chains 24 and again engage cams 52.

With reference to FIGS. 3,9 and 10 it will be seen that coveyor chains 24 travel along tracks 38 which extend longtitudinally along the length of case sealer 10. Tracks 38 have a pair of longitudinal grooves 40,42 formed therein. Grooves 40 have a widened portion or shelf 44 located at the ends of tracks 38 adjacent to the entrance of case sealer 10. Conveyor chains 24 pushers 46 pivotally mounted thereon. Only three pushes 46 are shown in FIG. 3 for the purposes of clarity, but the pushers 46 are spaced longitudinally all along the chains 24 at intervals of about 8 to 12 centimetres. Pushers 46 stand up to push a box through case sealer 10, but when they lie down they have downwardly depending legs 48 and 50 on either side of chains 24. When pushers 46 are lying down, the legs 50 normally travel along in respective grooves 40, and legs 48 normally travel oover the top edge 51 forms a sidewall of groove 42. However, when it is desired to have pushers 46 stand up to engage a box, a cam 52 is moved inwardly causing a tab 53 on leg 48 to engage cam 52 and move pusher 46 transversely or sideways. This causes leg 50 to move sideways and engage another cam 54, which is actually one of the side walls of groove 40. This cause the pusher 46 to tilt upwardly into an upright position so that it can engage a box to be pushed through case sealer 10. Tabs 53 ride along in groove 42 to keep pushers 46 upright.

According to the invention, there is provided a case sealer comprising a frame having a longitudinal axis and including an entrance conveyor for moving boxes entering the case sealer along the axis. A pair of longitudinal, spaced-apart, lateral conveyors is located to receive boxes from the entrance conveyor. Linking means are provided for linking the lateral conveyors together for equal movement inwardly and outwardly to match the width of a box passing therethrough. The lateral conveyors include converging centering conveyor belts forming a throat to center a box therebetween, and means actuatable upon a box contacting both centering conveyor belts for moving the lateral conveyors outwardly while maintaining the box in contact with both centering conveyor belts. The lateral conveyors also include parallel first advancing conveyor belts for receiving a box from the centering conveyor belts, and means for urging the lateral conveyors inwardly for engagement of the first advancing conveyor belts with the box. A floating head is spaced above the lateral conveyors, the floating head including an upwardly inclined entry ramp adapted to engage and fold inwardly a forward end flap on a box. Means are provided for lifting the floating head upwardly. The entry ramp includes a sensor switch operatively connected to the means for lifting the floating head upwardly, the switch being activated to raise the floating head upon a top horizontal edge of the box engaging the inclined entry ramp, and deactivated when the floating head is clear of the top of the box. The floating head includes a pivoting arm assembly including a pivot arm pivotable downwardly after the box passes thereunder to fold inwardly a rearward end flap on the box. The floating head further includes diverging side bars for engaging and folding inwardly side flaps on the box after the rearward end flap has been folded inwardly. A seal dispensing platform is located downstream of the first advancing conveyor belts. The seal dispensing platform includes means for holding box flaps shut and means for locating the holding means adjacent to the box flaps. The seal dispensing platform is adapted to mount a seal dispenser centrally thereon for sealing the box flaps shut. The seal dispensing platform includes spaced-apart, parallel second advancing conveyors located to receive boxes from the first advancing conveyor belts, and means for urging the second advancing conveyors into engagement with a box for passing the box under the seal dispenser platform and out of the case sealer.

Figure 4:
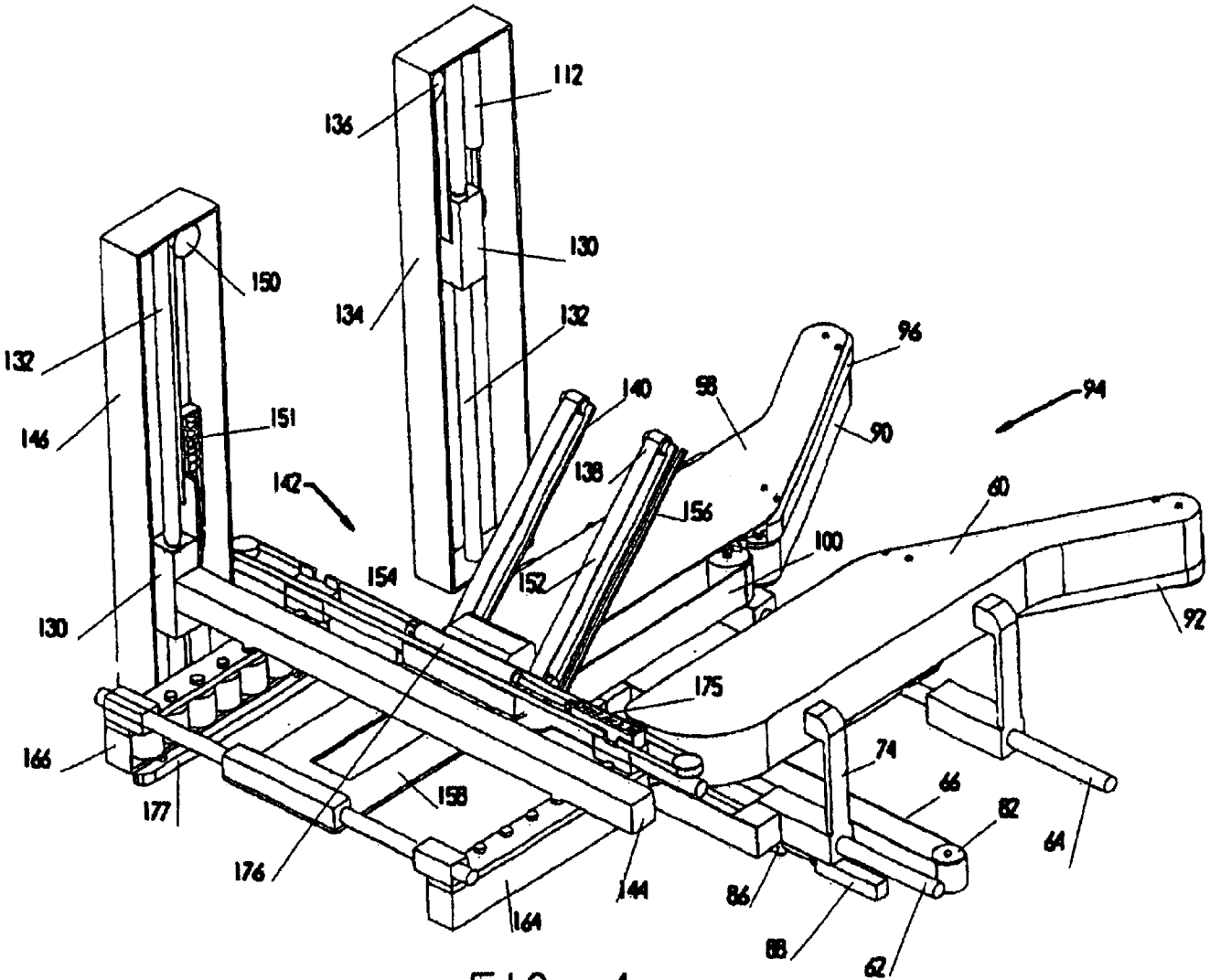
FIG. 4 is a perspective view taken from above and from the rear showing some of the components of the case sealer shown in FIGS. 1 and 2.
Figure 5:
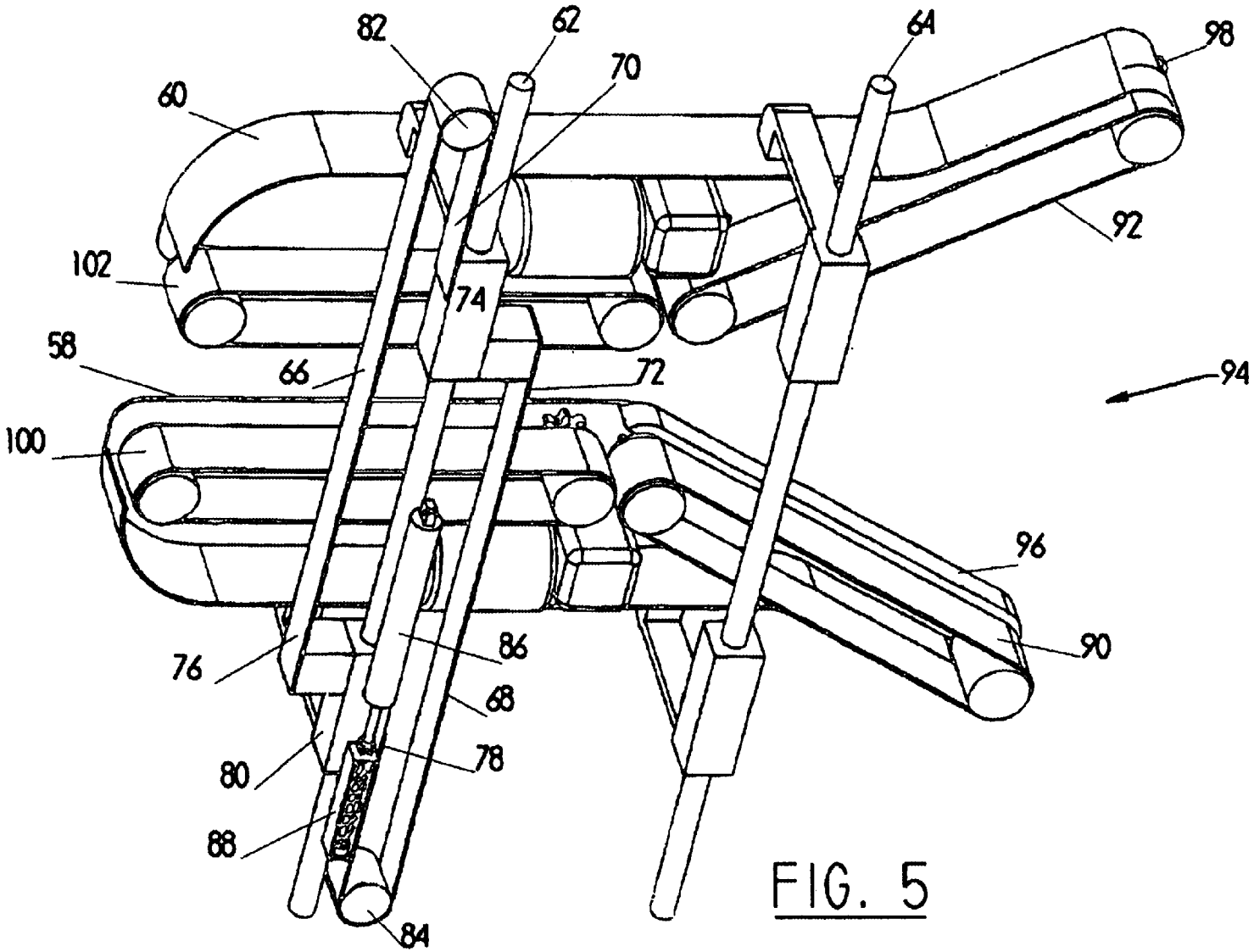
FIG. 5 is a perspective view taken from below of the lateral conveyors shown in FIGS. 1 and 2.

Referring next to FIGS. 4 and 5, lateral conveyors 58 and 60 are slidably mounted on transverse shafts 62 and 64 for inward and outward movement to adjust for the width of a box being sealed in case sealer 10. Lateral conveyors 58 and 60 are linked together for equal movement inwardly and outwardly to match the width of the box passing therethrough. The linking means includes a pair of belts 66 and 68 (see FIG. 5). Each belt has one respective end 70, 72 attached to a slide mount 74 which slidably mounts lateral conveyor 60 on shaft 62. Each of the belts 66 and 68 has a second opposed respective end 76, 78 attached to a second slide mount 80 which slidably mounts lateral conveyor 58 on shaft 62. Sheaves 82 and 84 are rotatably mounted in frame 12, so that belt 66 passes around sheave 82 and belt 68 passes around sheave 84, as a result, when slide mount 80 moves outwardly away from the longitudinal center line of case sealer 10, belt 66 causes slide mount 74 also to move outwardly away from the longitudinal center line of case sealer 10. Similarly, when slide mount 74 moves inwardly towards the center line of case sealer 10, belt 68 causes slide mount 74 to move inwardly towards the center line of the case sealer. Slide mount 74 is moved inwardly and outwardly by a pneumatic cylinder 86 mounted in frame 12 and acting through a spring mount 88 attached to slide mount 80. Spring mount 88 provides some flexibility for the relative positioning of lateral conveyors 58 and 60 to accommodate some non-uniformity in the width of the boxes being sealed in case sealer 10. The belts 66 and 68 pass around sheaves 82 and 84 in a U-shaped fashion. Chains and sprockets could be used in place of belts and sheaves. Other devices, such as racks and a pinion could also be used to link the lateral conveyors together, so that outward and inward movement of one lateral conveyor causes respective outward and inward movement of the other lateral conveyor.

Lateral conveyors 58 and 60 have diverging centering conveyor belts 90 and 92 forming a throat 94 to center a box therebetween. As seen best in FIG. 1, if a box travelling toward lateral conveyors 58 and 60 is off center, it will hit one of the centering conveyor belts 90 and 92 first, and this centering conveyor belt will move the box over toward the center.

Lateral conveyors 58 and 60 also have centering sensors 96 and 98 mounted just above their respective centering conveyor belts 90 and 92. Centering sensors 96 and 98 are pivotably mounted bars that actuate limit switches behind them. When a corner of the box hits one of the centering sensors 96 or 98, the sensor retracts closing its limit switch while still allowing the box to engage the respective centering conveyor belt 90 or 92. This causes the box to be moved over toward the center of the case sealer. When both the centering sensors 96 and 98 are engaged by the box, the box is centered. The respective limit switches in sensors 96 and 98 are connected in series and when both switches are closed, this causes a controller to actuate cylinder 86 and cause the lateral conveyors 58 and 60 to open up to accommodate the box. Cylinder 86 acts slowly enough to ensure that both corners of the advancing box remain in contact with centering conveyor belts 90 and 92 and the speed of centering conveyor belts 90 and 92 is higher than entrance conveyor 22 so that the boxes advance at the same speed as the pushers 46 are moving along entrance conveyor 22.

Figure 7:
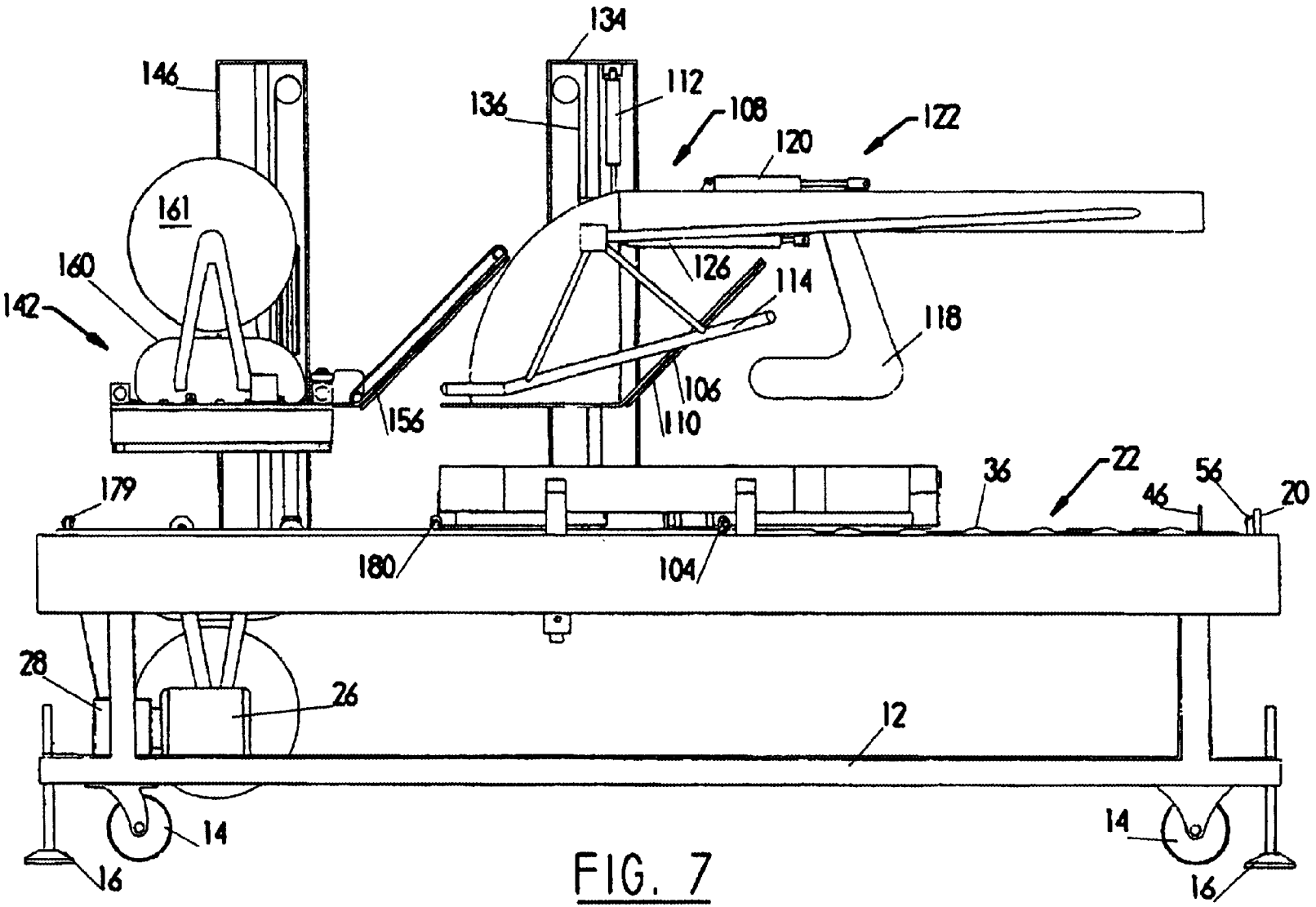
FIG. 7 is a side elevational view taken along lines 7—7 of FIG. 1.

The box continues to advance until the leading vertical corners of the box engage a pair of parallel, first advancing conveyor belts 100 and 102 mounted in the respective lateral conveyors 58 and 60. As this happens, the box trips another limit switch 104 (see FIG. 7) causing the controller to close the control valve controlling cylinder 86 to lock the first advancing conveying belts 100 and 102 in engagement with the box therebetween. The first advancing conveyor belts 100 and 102 then continue at the same speed as entrance conveyor 22 to move the box through case sealer 10 until the leading top flap of the box engages a 45 degree upwardly inclined entry ramp 106 mounted in a first floating head 108 spaced above the lateral conveyors 58 and 60. Entry ramp 106 includes a sensor bar 110. When the top horizontal edge of the box hits sensor bar 110, this causes a controller to actuate another pneumatic cylinder 112 and raise floating head 108 upwardly at a speed such that top horizontal edge of the box remains in contact with entry ramp 106. As the top flap of the box is folded downwardly and the top of the box passes under sensor bar 110, its limit switch opens causing the control valve operating cylinder 112 to close locking the floating head 108 in position. In this way, floating head 108 rises filled. As the box advances further, upwardly and outwardly disposed side bars 114 and 116 engage the box side flaps and fold them inwardly. Before the box side flaps are folded down, however, the trailing end flap of the box is folded downwardly by a pivot arm 118 actuated by another pneumatic cylinder 120. Pivot arm 118 can be activated by limit switch 104.

Pivot arm 118 and pneumatic cylinder 120 are part of a pivot arm assembly 122 slidably mounted in a boom 124 mounted in floating head 108. Pivot arm assembly 122 is moved along boom 124 by another pneumatic cylinder 126 to accommodate and close the trailing end flaps of boxes of varying lengths up to about 2 meters or even longer simply by making boom 124 and entrance conveyor 122 longer, as required. Where such long boxes are sealed in case sealer 10, the position of the pivot arm assembly and the activation of the pivot arm 118 is controlled by the limit switch 56 which senses when the trailing end wall of the box has entered the entrance conveyor 22.

Floating head 108 includes a transverse member 128 attached at its opposed distal ends to slides 130 mounted for vertical sliding movement on shafts 132 in towers 134. Cylinders 112 mounted in towers 134 are connected to slides 130 to move the floating head 108 up and down, as mentioned above. Towers 134 further include counterweight devices 136 attached to slides 130 to offset the weight of floating head 108. Counterweight devices 136 could be gravitational devices or coil spring type devices, as desired.

Figure 8:
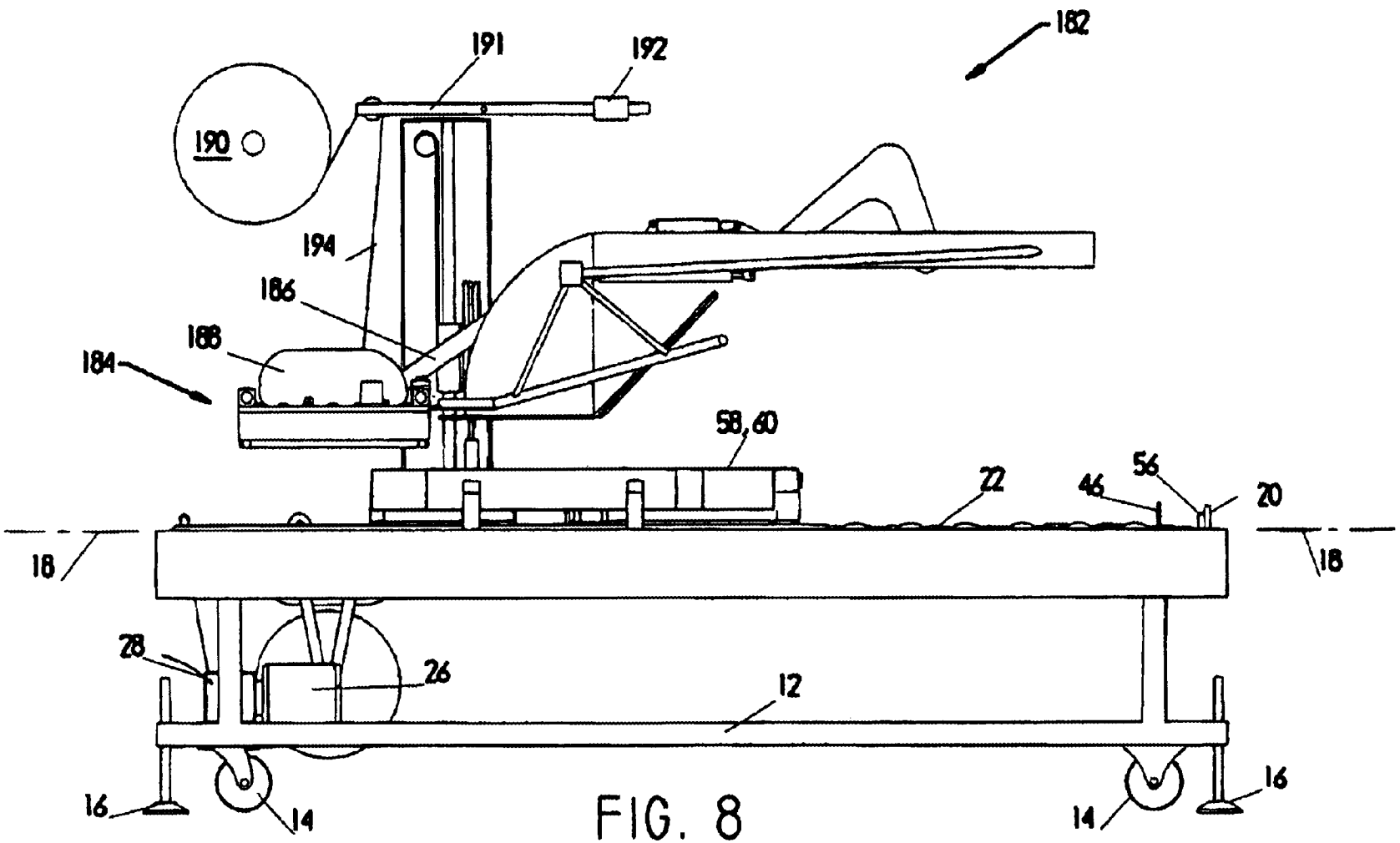
FIG. 8 is a side elevational view similar to FIG. 7 but showing a second preferred embodiment of the present invention having only one floating head.

As the box passes out through the lateral conveyors 58, 60 and while the box top flaps are still being held down by floating head 108, the top, leading horizontal edge of the box engages a pair of entry ramps 138 and 140 mounted in a second floating head 142. Entry ramps 138 and 140 are also inclined at an angle of 45 degrees, like ramp 106. Floating head 142 is similar to floating head 108 in that it has a transverse member 144 having opposed ends attached to slides 130 slidably mounted on shafts 132 in towers 146 with pneumatic cylinders 148 to move the floating head up and down and counterweight devices 150 to offset the weight of the floating head 142. Cylinders 148 are attached to slides 130 through spring mounts 151 to provide some flexibility for the relative positioning of floating head 142 and to accommodate some non-uniformity in the height of the boxes (up to 10 centimeters) such as may be caused by overfilling, for example. Entry ramps 138 and 140 themselves have conveyor belts 152 and 154 mounted thereon, and one of the entry ramps includes a sensor bar 156 which operates a limit switch connected to cylinder 148 through an appropriate controller and actuator valve device to raise second floating head 142 at a speed to maintain the box in contact with entry ramps 138, 140. When the floating head 142 is raised sufficiently to allow the box to pass under ramps 138, 140, the sensor bar 156 stops the vertical movement of the second floating head 142 and the box passes under a seal dispensing platform 158. Again, this allows over filled boxes to be accommodated. Seal dispensing platform 158 is located downstream of the first advancing conveyor belts 100, 102 of the first floating head 108, and the seal dispensing platform 158 is means for holding the box flaps shut until they are sealed by a sealing device such a tape machine or dispenser 160 mounted on seal dispenser platform 158. FIG. 1 shows a taping machine 160 where the tape supply 161 is mounted on the taping head. However, it is preferable to have the tape supply mounted separately on frame 12, as shown in FIG. 8. In any event, any type of tape dispenser 160 could be used in the subject invention.

Figure 6:
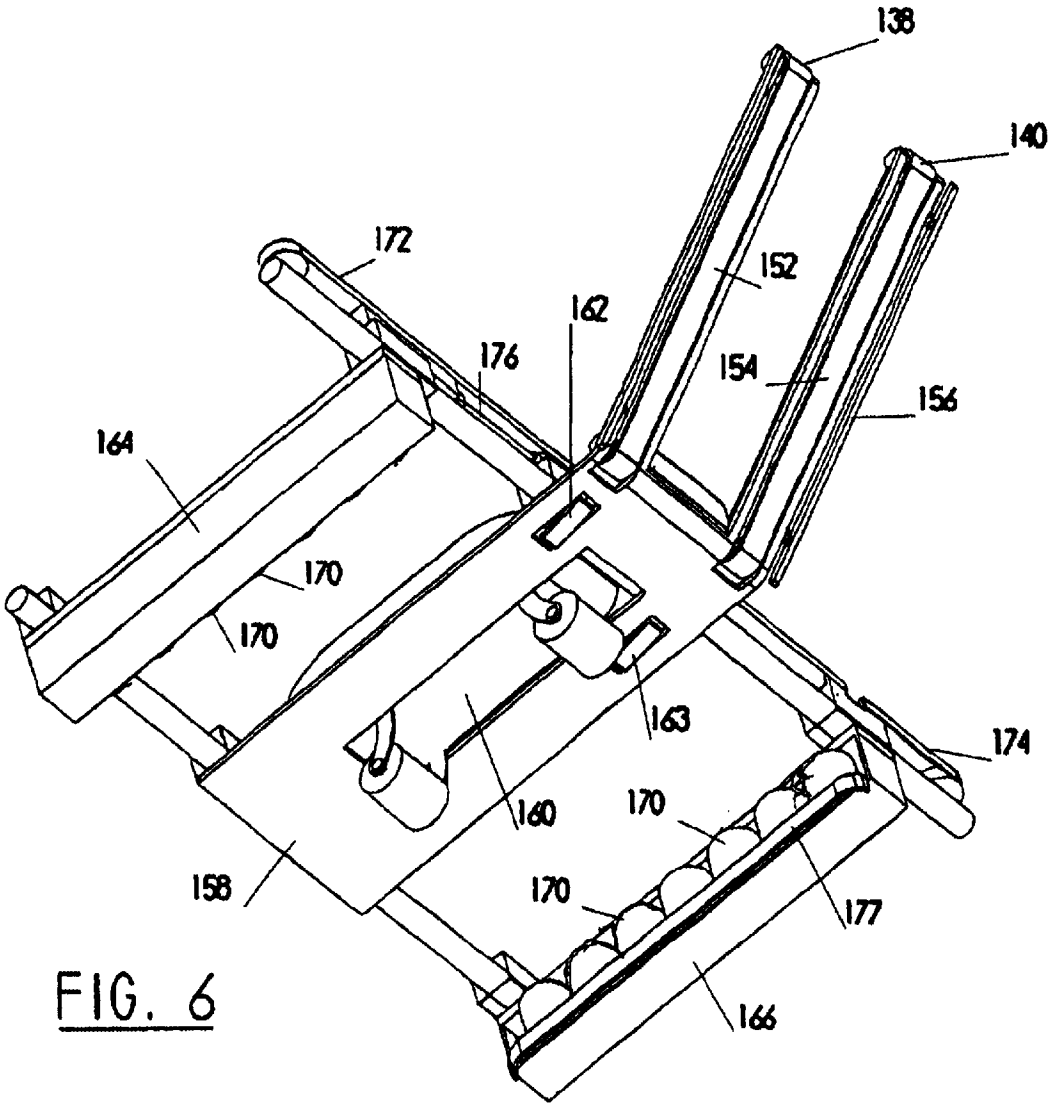
FIG. 6 is a perspective view taken from below of the tape dispensing platform shown in FIGS. 1 and 2.

As the box passes under seal dispensing platform 158, it engages another limit switch 162 which causes seal dispensing platform 158 to move downwardly to apply pressure to the top of the box and also cause the spaced-apart, parallel, second advancing conveyors 164 and 166 to move inwardly to engage the sides of the box. Conveyors 164 and 166 preferably are formed of free wheeling rollers 170 as indicated in FIG. 6. Further advance of the box causes it to hit another limit switch 163 to lock seal dispensing platform 158 in position.

Second advancing conveyors 164, 166 are linked together by linking belts 172, 174 (see FIG. 6) in a manner similar to the belts 66 and 68 of the lateral conveyors 58 and 60. In this way, the second advancing conveyors 164 and 166 move inwardly and outwardly simultaneously using only one actuating cylinder 176 acting through a spring mount 175. One of the second advancing conveyors 164, 166 has a sensor bar 177 to sense when the sides of the box are engaged by conveyors 164 and 166, control the pressure of conveyors 164 and 166 on the box, and lock conveyors 164 and 166 in position. When the box passes the second floating head 142 and tape dispenser 160, sensor 179 (see FIG. 7) senses this and allows conveyors 164 and 166 to open again and floating head 142 to rise to be ready for the next box to be sealed.

In the operation of case sealer 10, the case sealer can be made to operate in several different modes as selected by a control box 178. Where the boxes are all of the same height, width and length, the gate mechanism 20 can be opened at regular intervals almost as soon as the rear wall of a box ahead passes limit switch 56. This will provide a gap or spacing between the boxes of about 25 to 35 centimeters. The speed of entrance conveyor 22 and lateral conveyors 58 and 60 is such that the first box will clear the lateral conveyors 58 and 60 so that they return to their starting position before the next box engages the centering conveyor belts 90 and 92. Lateral conveyors 58 and 60 return inwardly to their starting position when a limit switch 180 (see FIG. 7) senses that the box between them has cleared the lateral conveyors 58 and 60. Alternatively, lateral conveyors 58 and 60 can stay in their existing position, because the next box is of the same width. The box can go on to be sealed by the floating sealing head 142 while another box is entering lateral conveyors 58 and 60 to have its flaps folded down by floating head In a second mode of operation where the height and width of the boxes are the same but the lengths of the boxes vary, the cylinder 126 moves the pivot arm assembly 122 out to the end of boom 124, and as soon as the rear end of the box is sensed passing limit switch 56, cylinder 126 retracts the pivot arm assembly 122, so that pivot arm 118 travels along at the same speed as the box. Just prior to the box side flaps being folded down on top of the box front flap by side bars 114, 116, pivot arm 118 comes down to close the back flay of the box. This could be triggered by the box hitting limit switch 104. Limit switch 56 also causes the pushers 46 to pop up behind the box, as mentioned above.

In a third mode of operation where the boxes vary in length, width and height between about 15 and 60 centimeters, the pivot arm assembly 122 stays in its inward or retracted position, but the gate mechanism 20 is not lowered to let the next box enter the case sealer until the previous box has passed limit switch 104. Limit switch 104 can also be used to activate pivot arm 118. This allows the first floating head station and lateral convevors 58 and 60 to be reset to accept the next randomly sized box.

In a fourth mode of operation, where the boxes vary in width and heights and also in length between about 50 centimeters and about 1.5 meters, the pivot arm assembly 122 extends to the outer end of boom 124 and retracts with the box as in the second mode above. When the front of the box hits limit switch 104, pivot arm 118 comes down to close the rear box flag. However, when the rear end wall of the box passes limit switch 56, the gate mechanism 20 does not open again until the rear of the box has passed limit switch 104.

Referring next to FIG. 8, another preferred embodiment of a case sealer 182 is shown. The same reference numerals have been used in FIG. 8 to indicate components that are essentially the same as those of the embodiments shown in FIGS. 1–7. In the FIG. 8 embodiment, the second floating head has been eliminated and the seal dispensing platform 184 that corresponds to FIG. 6 has been attached to the first floating head 108 by attachment members 186. Case sealer 182 is also shown having a preferred type of taping machine 188 where the supply of tape 190 is located above the seal dispensing platform 184. A pivoting tension bar 191 with an adjustable counterweight 192 maintains tension in the tape 194 even though the tape machine 188 is moving up and down. Case sealer 182 works in a maimer similar to case sealer 10 but the box being sealed has to clear the seal dispensing platform 184 before the lateral conveyors 58 and 60 can be reset to accept the next box to be sealed.

Having described preferred embodiments of the invention, it will be appreciated that various modifications may be made to the structures described above. For example, instead of using pneumatic cylinders to control the various components of the case sealers, it will be appreciated that hydraulic devices or electric motors or solenoids could be used as well. Programmable logic controllers are preferred for controlling the various components of the case sealers, but other types of controls could be used as well, such as simple timers. Limit switches have been described as the preferred position sensors, but other devices such as photoelectric, infrared or other motion sensors or proximity sensors could be used as well.

As will be apparent to those skilled in the art in light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A case sealer comprising:

a frame having a longitudinal axis and including an entrance conveyor for moving boxes entering the case sealer along the axis;

a pair of longitudinal spaced-apart, lateral conveyors located to receive boxes from said entrance conveyor;

linking means for linking the lateral conveyors together for movement inwardly and outwardly to match the width of a box passing therethrough;

said lateral conveyors including converging centering conveyor belts forming a throat to center a box therebetween, and means actuatable upon a box contacting both centering conveyor belts for moving the lateral conveyors outwardly while maintaining said box in contact with both centering conveyor belts;

said lateral conveyors also including parallel first advancing conveyor belts for receiving a box from the centering conveyor belts, and means for urging the lateral conveyors inwardly for engagement of the first advancing conveyor belts with said box;

a floating head spaced above the lateral conveyors, said floating head including an upwardly inclined entry ramp adapted to engage and fold inwardly a forward end flap on a box; means for lifting the floating head upwardly; the entry ramp including a sensor switch mounted therein and operatively connected to the means for lifting the floating head upwardly, said switch being activated to raise the floating head whenever a top of said box engages said inclined entry ramp, and deactivated when the floating head is clear of the top of the box; said floating head including a pivoting arm assembly including a pivot arm pivotable downwardly after said box passes thereunder to fold inwardly a rearward end flap on said box, said floating head further including diverging side bars for engaging and folding inwardly side flaps on said box after the rearward end flap has been folded inwardly;

a seal dispensing platform located downstream of the first advancing conveyor belts, the seal dispensing platform including holding means for holding box flaps shut and means for locating said holding means adjacent to said box flaps, the seal dispensing platform being adapted to mount a seal dispenser centrally thereon for sealing said box flaps shut, the seal dispensing platform including spaced-apart, parallel second advancing conveyors located to receive boxes from the first advancing conveyor belts, and means for urging said second advancing conveyors into engagement with a box for passing said box under the seal dispensing platform and out of the case sealer.

2. A case sealer as claimed in claim 1 wherein the means for moving the lateral conveyors outwardly includes a pneumatic cylinder and a controller therefor to match said outward movement to the speed of the entrance conveyor and the angle of divergence of the centering conveyor belts.

3. A case sealer as claimed in claim 1 wherein the means for urging the lateral conveyors inwardly includes a pneumatic cylinder and a controller therefor.

4. A case sealer as claimed in claim 3 and further comprising sensor means connected to the controller to sense the presence of a box between the first advancing conveyor belts and lock the lateral conveyors in position.

5. A case sealer as claimed in claim 1 and further comprising a second floating head located downstream of the first floating head, the seal dispensing platform being mounted on the second floating head, the second floating head including an upwardly inclined entry ramp adapted to be engaged by a box passing out of the first advancing conveyor belt and means for lifting upwardly the second floating head to a predetermined desired height for engagement of the seal dispenser against the box flaps to seal the box shut.

6. A case sealer as claimed in claim 5, wherein the first and second floating heads include transverse members having distal ends, and wherein the frame includes upright towers including slides connected to said distal ends for up and down floating movement of the floating heads.

7. A case sealer as claimed in claim 6 wherein the towers further comprise counterweights connected to the slides to offset the weight of the floating heads.

8. A case sealer as claimed in claim 5 wherein the second floating head upwardly inclined ramp includes a sensor switch operatively connected to the means for lifting the second floating head, said switch being activated upon a top horizontal edge of a box engaging the entry ramp and deactivated when the second floating head is clear of the top of the box.

9. A case sealer as claimed in claim 5 wherein the means for lifting the second floating head upwardly includes speed regulating means for ensuring that the top horizontal edge of the box remains in contact with the entry ramp as the second floating head is being lifted.

10. A case sealer as claimed in claim 5 wherein the entry ramp is inclined at an angle of 45 degrees.

11. A case sealer as claimed in claim 5 wherein the means for lifting upwardly the second floating head includes spring mounts to accommodate oversize boxes and maintain pressure on the top of the box by the second floating head.

12. A case sealer as claimed in claim 1 wherein the seal dispenser is a tape dispenser including means for taping the box flaps shut.

13. A case sealer as claimed in claim 1 wherein the floating head includes a boom extending over the entrance conveyor, the pivot arm assembly being slidably mounted on said boom, and further comprising means for sliding the pivoting arm assembly along the boom to accommodate and close the end flaps of boxes of varying length.

14. A case sealer as claimed in claim 1 wherein the linking means includes transverse shafts, the lateral conveyors being slidably mounted on said shafts, a pair of belts having opposed ends attached respectively to each lateral conveyor, and sheaves mounted on said shafts around which the belts pass in a U-shaped fashion, so outward and inward movement of one lateral conveyor causes respective outward and inward movement of the other lateral conveyor.

15. A case sealer as claimed in claim 1 wherein the entrance conveyor includes a plurality of spaced-apart pushers pivotally mounted thereon, and means responsive to a box being located on the entrance conveyor for standing the pushers upright to engage said box and push it along the entrance conveyor.

16. A case sealer as claimed in claim 15 wherein the pushers are spaced apart longitudinally on the entrance conveyor at intervals between 8 and 12 centimeters.

17. A case sealer as claimed in claim 15 wherein the floating head includes means for pivoting the pivot arm downwardly at the same time as the pushers are stood upright.

18. A case sealer as claimed in claim 1 wherein the means for lifting the floating head upwardly includes speed regulating means for ensuring that the top horizontal edge of the box remains in contact with the entry ramp as the floating head is being lifted.

19. A case sealer as claimed in claim 1 wherein the entry ramp is inclined at an angle of 45 degrees.

* * * * *